US005664546A

United States Patent [19]

De La Torre Barreiro

[11] Patent Number: 5,664,546

[45] Date of Patent: Sep. 9, 1997

[54] FUEL SAVING DEVICE

[76] Inventor: Jose Luis De La Torre Barreiro, Rafael Calvo 30, Madrid, Spain, 28010

[21] Appl. No.: 500,940

[22] PCT Filed: Mar. 18, 1994

[86] PCT No.: PCT/ES94/00029

§ 371 Date: Mar. 13, 1996

§ 102(e) Date: Mar. 13, 1996

[87] PCT Pub. No.: WO95/14855

PCT Pub. Date: Jun. 1, 1995

[30] Foreign Application Priority Data

Nov. 22, 1993 [ES] Spain ..... 9303076 U

[51] Int. Cl.[6] ..... F02M 27/04; F23C 11/00

[52] U.S. Cl. ..... 123/538

[58] Field of Search ..... 123/538, 536, 123/537; 210/222, 695

[56] References Cited

U.S. PATENT DOCUMENTS

| | | | |
|---|---|---|---|
| 4,265,754 | 5/1981 | Menold | 210/695 |
| 4,372,852 | 2/1983 | Kovacs . | |
| 4,711,271 | 12/1987 | Weisenbarger et al. | 123/538 |
| 4,808,306 | 2/1989 | Mitchell et al. | 123/538 |
| 5,122,277 | 6/1992 | Jones | 210/695 |
| 5,411,143 | 5/1995 | Greene | 210/695 |
| 5,500,121 | 3/1996 | Thornton et al. | 123/538 |

FOREIGN PATENT DOCUMENTS

| | | |
|---|---|---|
| 0544395 | 6/1993 | European Pat. Off. . |
| 59-93954 | 5/1984 | Japan . |
| 59-176504 | 10/1984 | Japan . |
| 2209030 | 4/1989 | United Kingdom . |
| WO90/06809 | 6/1990 | WIPO . |
| WO91/01277 | 2/1991 | WIPO . |
| WO93/09868 | 5/1993 | WIPO . |

*Primary Examiner*—Marguerite McMahon

*Attorney, Agent, or Firm*—Head, Johnson & Kachigian

[57] ABSTRACT

A fuel economizer having a non-magnetic body surrounding a fuel feed pipe and fitted with internal magnets. The fuel economizer includes two half casings of non-magnetic material, joined to each other by a clamp that keeps them attached to the pipe through which the fuel runs. A magnetic field perpendicular to the pipe is generated by a first magnet and a magnetic field axial to the pipe is generated by a second magnet. A third magnet has a perpendicular field with its poles inverted with respect to the first magnet. The magnets are separated an equal distance from each other. Utilizing low carbon iron pieces in the magnet housing, the flow is concentrated toward the inside of the conduit to prevent exit of the flow towards the outside of the economizer.

4 Claims, 3 Drawing Sheets

FUEL SAVING DEVICE

CROSS-REFERENCE TO RELATED APPLICATIONS

This application relates to PCT application No. ES94/00029 which claims priority from Spanish Patent Application No. U9303076 filed 22 Nov. 1993.

BACKGROUND OF THE INVENTION

1. Field of the Invention

The invention refers to a fuel economizer device used in the conduction of fuel to internal combustion engines, mobile or static, as well as to liquid fuel boilers, and is characterized by its high level of savings through the incorporation of a fuel conduction bipolar magnetic field.

This economizer is configured by two parts joined together by external lateral clamps on an aluminum casing enclosing three aligned groups of two low carbon iron pieces and another three groups of two magnets. All of them are built with strong magnetic induction and high thermal resistance with materials such as neodymium—iron plus boron and quality M-35. All three groups of magnets are placed upon the low carbon iron parts within each aluminum half casing.

2. Prior Art

There are different methods commonly used to retain fluid impurities, the most common of them being those applied using chemical products.

Notwithstanding the foregoing, an important industrial niche has opened up in the magnetic treatment of fluids, specially for water treatment, derived from the advantage offered by the magnets regarding their total absence of maintenance, the non-existence of replacement expenses due to any loss of their functional features, meaning a reduction of magnetism levels within periods measurable in the course of financial cycles, ease of installation and other advantages.

Regarding cleaning the filter of accumulated deposits resulting from any non-ionizable material dragged downstream from the economizer, logically there is no difference as to the treatment of both systems.

As a scale remover in drinking water distribution networks there are a large number of patents and utility models that may be referenced, whereas we shall do so in relation to Applicant's Pat. No. 8,903,003 entitled "Magnetic Fluid Treatment Conditioner". Pat. No. 8,903,003 claims, among other improvements, within a casing and two intermediate aluminum separators, three magnetic fields, two radial end ones and an axial central one, which define a joint field of altered angle generated by ring shaped permanent magnets. The first two magnets have field concentrating gaps above the passage pipe section which has a flow regulating device. The axial field is generated by three magnet groups, polarly intercoupled and coaligned.

Another system similar in its objectives, but as a prior filter in electrolytic chambers, is that featured in Pat. No. 8,903,388 entitled, "Improvement In Hydroxy Gas Generating Apparatuses", as well as a good number of them.

The characteristic feature of all of these treatments is the ionic polarization of the salts dissolved in water which prevents the occurrence of micro-crystal deposits.

More recently, some experiences of application of magnetic fields to fluid fuel circuits were effected, making reference to the following patents:

| Number | Title |
|---|---|
| 9001205 | "Device To Improve The Performance Of Internal Combustion Engines" |
| P9001993 | "Magnetic Fluid Conditioner" |
| E90304105 | "Combustible Hydrocarbon Treatment" |
| E90305599 | "Fuel Combustion Efficiency Improvement" |
| E90901375 | "Fluid Magnetic Treatment Apparatus" |
| E91114449 | "Fuel Treatment Magnetic Apparatus" |
| As well as the models: | |
| U9201746 | "Magnetic Device For The Treatment Of Automobile And Similar Liquid Fuels" |
| U9202019 | "Device For The Purification Of Fuel In Motor Driven Vehicles" |

In all of the above cases magnets are used of differing magnetic flow density, arranged individually or in groups, but always defining a unique magnetic field type, commonly of the axial type, and following an individual magnet arrangement.

It is already known from practical experience that performance in the case of water circulation through a pipe is optimized if flowing speed is kept as constant as possible.

Regarding the application of magnetizers in liquid fuel pipes, some consumption measuring experiences are known and have found fuel consumption reductions of up to 30% under identical operating conditions.

Notwithstanding this, its application is not universal, and it is not normal for a device manufactured for a specific application to be suitable for use in respect of different applications. For instance, a gas oil economizer may not be easily and successfully used on a gasoline conduit and vice versa, just as those applied in trucks are not very practical for heating boilers and have no use whatsoever in diesel engined automobiles.

SUMMARY OF THE INVENTION

The invention advanced herein endeavors to successfully solve the previously described problem through an application that can be universally used with the appropriate modifications for adaption to different types of fluid, such as liquid fuel.

To this end the present invention is configured in an arrangement that incorporates a pipe inside it without requiring it to be cut and, depending on varieties, before its mixture with air, whenever any such mixture may be required.

For its application to two and four stroke engines as well as to other alternating type engines, a non-magnetic body is fitted in the fuel flow direction, such as aluminum, covering a pipe track, in two longitudinal half casings capable of being joined by way of a flange or any other conventional means.

From left to right and in this flow direction, there is in each half casing a magnet with its North pole in the upper position and its South pole in the lower position, inducing a perpendicular field to the pipe.

An opposite magnet and in the opposite direction field is then arranged at the other end of the economizer, thus generating a new perpendicular field.

These magnets are embedded into the aluminum block, leaving enough separation to incorporate between them and within the block another North—North magnet generating an axial field, reaching the limits of both adjacent perpendicular fields. This arrangement is the normal one for conduits feeding gasoline to the carburetor. In the case of gas oil the economizer is placed in the opposite direction.

Generally, axial fields are employed for slow circulation speeds and perpendicular fields for fast speeds.

Modifications may similarly be effected not only in the orientation of the economizer apparatus but also in the intensity of the magnetic flow of the fields. The magnetic flow of the fields may vary between just a few gauss up to and close to two thousand gauss. In addition, modifications may be affected according to the characteristics of engines and boilers and also affecting the distribution of the magnets themselves. It being possible to substitute the fore mentioned configurations for others being made up of:

an axial and a perpendicular field;

a perpendicular and an axial field;

two axial fields and a perpendicular one;

a perpendicular and two axial fields;

two consecutive North—North and one South—South fields;

a South—South and two North—North fields.

Any of the above arrangements, as far as the application is concerned, are capable of maintaining in suspension precipitable solids, components or additives of the fuel that are mostly ionizable, whereas the hydrocarbon itself is not.

Three groups of low carbon iron pieces are introduced into the bottom of the magnet casing before the magnets are placed therein so that they break up the symmetry of the magnetic field. The magnets concentrate the flow towards the inside of the conduit on the one hand and, on the other, prevent its exit towards outside the economizer, thus preventing possible functional defects in other devices due to the influence of this external residual magnetic field.

BRIEF DESCRIPTION OF THE DRAWINGS

In order to complement the description given herein and to facilitate a better and easier comprehension of the characteristics of the invention, this patent specification is accompanied, as an integral part thereof, by a set of drawings which are merely illustrative but never limited in character. The following being represented.

DETAILED DESCRIPTION OF THE PREFERRED EMBODIMENTS

Figure 1:
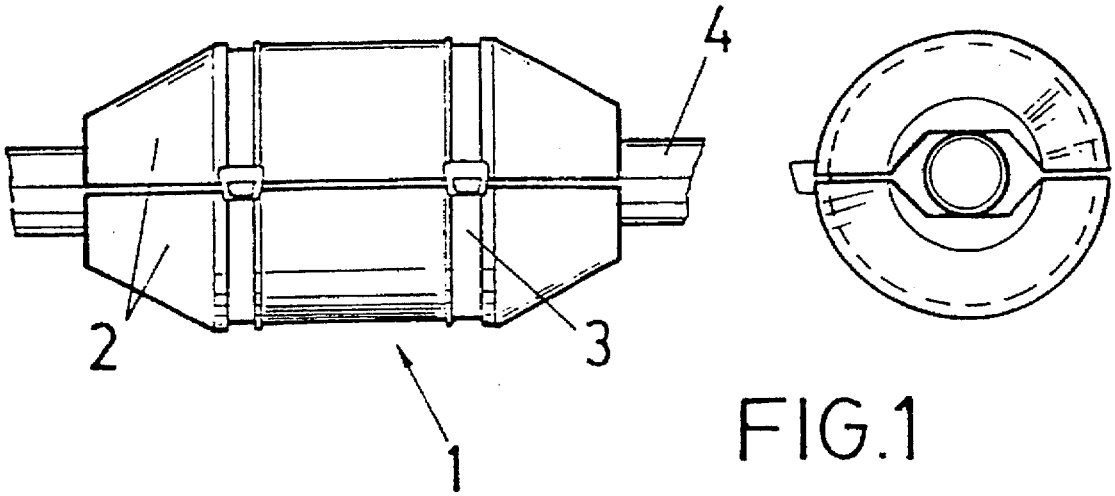
FIG. 1 shows a front elevation and one of the identical side profiles of the economizer.
Figure 2:
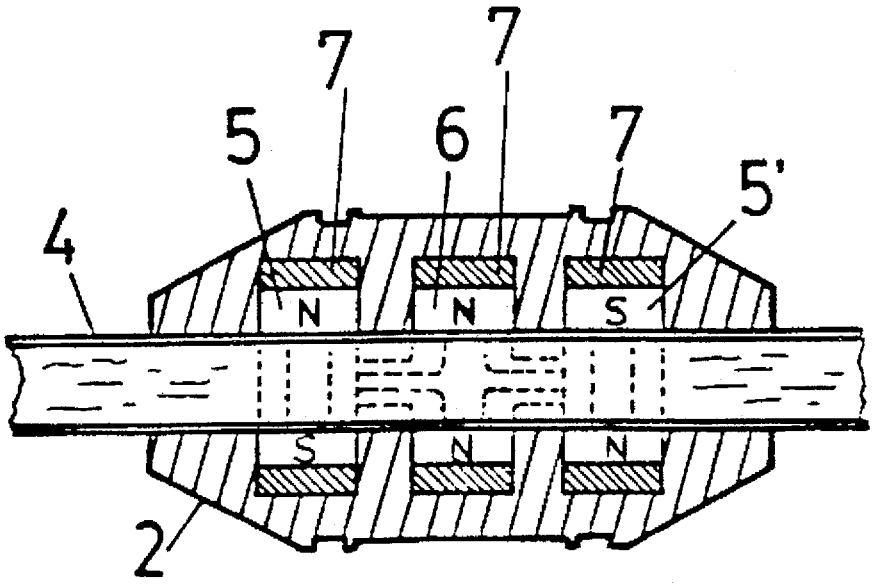
FIG. 2 shows, in a section view, an arrangement of the previously discussed group of magnets, generally used for Otto cycle type automobiles, where two consecutive perpendicular fields may be observed, that is, North–South and South–North, crossing an axial North—North field.
Figure 3:
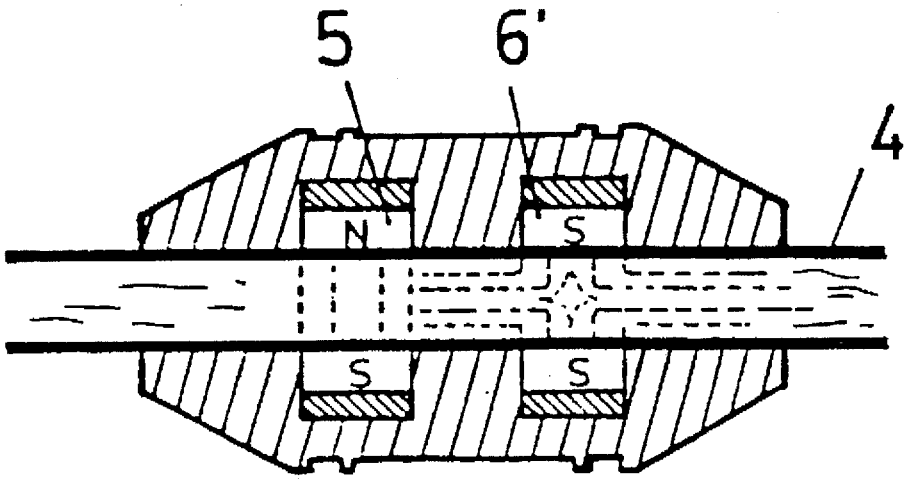
FIG. 3 shows the variant of two fields, one perpendicular and the other axial, in consecutive arrangement. It being understood that from these drawings any combination may be deduced, as per the specific applications, for the various motor and burner market variants.

Upon seeing the previously commented figures, it may be observed how the invention advanced herein is made up of a non-magnetic body, a fuel economizer (1) configured by two longitudinal half body casings (2) made of non-magnetic material joined to each other by a clamp (3) that keeps them attached to a pipe (4) through which runs the fluid A series of magnets are held in housings within the non-magnetic body. Three magnets (5), (6), and (5') are arranged in series. A first magnet (5) generates a field perpendicular to the pipe (4). In addition, to the perpendicular field generated by the first magnet (5) incorporated in each half body (2), the magnet (6) is then joined, separated from it and also incorporated into each half casing (2), configuring an axial field, followed by another perpendicular field, generated by the magnet (5') with its poles inverted in respect of the first of them. Magnet (5') is separated an equal distance from the previous one just as the second one is located apart from the first one and is embedded into each half casing (2).

The intensity of the magnetic field generated is, designed to cover the conduit diameter which may vary according to the engine or liquid fuel burner, and is also a function of the characteristics of the circulating hydrocarbon, so that it may be arranged, for instance, as only two magnets (5) perpendicular and (6') axial, inside of the half casing (2).

Three groups of low carbon iron pieces (7) located in the bottom of the magnet housing concentrate magnetic flow towards the inside of the conduit and prevent its exit towards the outside of the economizer.

It is not considered necessary to extend this description any further on the understanding that any expert in this art would have enough information to comprehend the scope of the invention and the advantages derived from it, as well as to be able to reproduce it.

It is further understood that as long as the essential features of the invention are not altered, its materials, shape, size and arrangement of the elements may be varied within the same characteristics.

The terms in which this specification has been described must at all times be considered in a wide and non-limitative sense.

I claim:

1. A fuel economizer surrounding a fuel feed pipe, the fuel economizer comprising:

a casing made of non-magnetic material formed of two longitudinal halves;

a clamp securing each of said casing halves to said pipe;

at least one first magnet positioned within at least one of said casing halves generating a magnetic field perpendicular to the pipe;

at least one second magnet positioned within one of said casing halves adjacent to said first magnet, said second magnet generating an axial magnetic field with respect to the pipe; and a plurality of low carbon iron pieces embedded within one of said casing halves directing magnetic flow created by said magnets towards the inside of the pipe and preventing magnetic flow from exiting the economizer.

2. A fuel economizer as set forth in claim 1 including a third magnet generating a magnetic field perpendicular to the pipe positioned adjacent to said second magnet separated an equal distance as said first magnet from said second magnet and said third magnet having its poles inverted with respect to said first magnet.

3. A fuel economizer as set forth in claim 1 wherein said low carbon iron pieces are embedded in a lower portion of one of said casing halves.

4. A fuel economizer as set forth in claim 1 wherein said first magnet is composed of a pair of magnet segments, each segment positioned with one opposed casing half and wherein said second magnet is composed of a pair of magnet segments, each segment positioned with one opposed casing half.

* * * * *